US006414291B1

(12) United States Patent
Kim

(10) Patent No.: US 6,414,291 B1
(45) Date of Patent: Jul. 2, 2002

(54) TRANSFORMER FOR A MICROWAVE OVEN

(75) Inventor: Cheol-Jin Kim, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/618,289

(22) Filed: Jul. 18, 2000

(30) Foreign Application Priority Data

Jul. 26, 1999 (KR) ..... 99-30303

(51) Int. Cl.[7] ..... H05B 6/64
(52) U.S. Cl. ..... 219/760; 219/715; 336/183
(58) Field of Search ..... 219/760, 715; 336/183, 206, 98, 160, 61, 182; 315/39.51; 29/602.1

(56) References Cited

U.S. PATENT DOCUMENTS 3,705,372 A * 12/1972 Gotal et al. ..... 336/182
4,081,776 A * 3/1978 Hisamoto et al. ..... 336/61
4,216,455 A * 8/1980 Hester ..... 336/160
4,858,095 A 8/1989 Narita et al.
4,885,445 A 12/1989 Taniguchi
4,886,951 A 12/1989 Matsumoto et al.
5,025,489 A 6/1991 Yamaguchi
5,660,756 A 8/1997 Calmettes et al.
5,954,988 A 9/1999 Lee
5,973,307 A 10/1999 Cho
6,297,593 B1 * 10/2001 Takashige et al. ..... 315/39.51

* cited by examiner

*Primary Examiner*—Teresa Walberg
*Assistant Examiner*—Quang Van
(74) *Attorney, Agent, or Firm*—Robert E. Bushnell, Esq.

(57) ABSTRACT

A transformer for a microwave oven capable of preventing quality deterioration thereof due to damaged insulating paper, includes a first core having a coil inserting section having one open side; a plurality of coils sequentially inserted into the coil inserting section in an inter-electrically insulated state; a second core coupled,to the first core, and for covering the open side of the coil inserting section; and a resin molding section formed to cover the whole area of the plurality of coils.

27 Claims, 6 Drawing Sheets

TRANSFORMER FOR A MICROWAVE OVEN

CLAIM OF PRIORITY

This application makes reference to, incorporates the same herein, and claims all benefits accruing under 35 U.S.C. §119 from an application entitled Transformer for a Microwave Oven earlier filed in the Korean Industrial Property Office on Jul. 26, 1999, and there duly assigned Serial No. 99-30303 by that Office.

BACKGROUND OF THE INVENTION

1. Field of the Invention

The present invention relates to a transformer for a microwave oven, and more a particularly to a transformer for a microwave oven having an improved insulating structure for a coil.

2. Description of the Related Art

Generally, a transformer for a microwave oven receives a particular commonly used voltage and outputs a high voltage for driving a magnetron. A magnetron is an electron tube in which the flow of electrons from the cathode to one or more anodes is controlled by an externally applied magnetic field. The magnetron is used to generate alternating currents at microwave frequencies. The magnetron is used in a microwave oven for producing microwaves for use in cooking food.

A transformer is an electrical device through electromagnetic induction transforms electric energy from one or more circuits to one or more-other circuits at the same frequency, but usually at a different voltage and current value. The transformer includes at least two coils. The transformer changes voltage in direct proportion to the ratio of the number of turns of its primary and secondary windings. A core is placed within the coils to intensify the magnetic field.

The cores and coils are insulated by an insulating paper. The insulating paper can be damaged by humidity or shock. Varnish impregnation may be performed on the transformer to prevent vibration between the cores and the coils through magnetic field changes, to improve the heat release characteristics, and to avoid dirt, humidity and foreign substances. The manufacturing cost is increased by varnish impregnation because of time needed for the process. Manufacturing time is further increased by a processes of removing varnish from areas of the transformers that cannot have the varnish. When using a vacuum impregnating method for varnish impregnation, the degree of varnish impregnation varies greatly causing possible defects. In a microwave oven, since vibration occurs at the iron plates of a transformer, the plates have to be firmly secured.

Exemplars of the art U.S. Pat. No. 5,660,756 for High-voltage Transformer for a Microwave Oven Power Supply issued to Calmettes et al., U.S. Pat. No. 4,858,095 for Magnetron Drive Apparatus issued to Narita et al., U.S. Pat. No. 4,885,445 for High-frequency Transformer for Microwave Oven issued to Taniguchi, U.S. Pat. No. 4,886,951 for Power Supply for a Magnetron Having a Rectifying Circuit, Switching Circuit, and Transformer issued to Matsumoto et al., U.S. Pat. No. 5,025,489 for Transformer Having Shielding Wall for Driving a Magnetron issued to Yamaguchi, U.S. Pat. No. 5,954,988 for High Voltage Transformer of a Microwave Oven Having a Structure for Radiating Heat issued to Lee, and U.S. Pat. No. 5,973,307 for High Voltage Transformer with Side Insulation Support and Formed with Through-holes for Lead Wires issued to Cho disclose transformers for microwave ovens.

I have found that the background art does not show a transformer for a microwave oven that has protection from internal and external shock, foreign substances, heat, while also reducing the cost of manufacture.

SUMMARY OF THE INVENTION

Accordingly, an object of the present invention is to provide a transformer for a microwave oven capable of preventing quality deterioration of the transformer which is caused by damaged insulating paper.

It is another object to provide a transformer for a microwave oven for preventing the difficulty of inserting a coil that is caused due to a burr of resin formed during the molding of the coil.

It is yet another object to provide a transformer for a microwave oven which maintains a uniform thickness of resin while molding the resin on the coil.

It is still another object to provide a transformer for a microwave oven capable of adjusting the number of stacks of a magnetic path core even after the size of the core and the coil is determined.

It is still another object to provide a transformer for a microwave oven having a reduced manufacturing cost by omitting a process of varnish impregnation.

It is still another object of the present invention to provide a transformer for a microwave oven having a reduced manufacturing cost by omitting a process of welding the respective cores.

The above object is accomplished by a transformer for a microwave oven according to the present invention, including a first core having a coil inserting section having one open side; a plurality of coils sequentially inserted into the coil inserting section in the inter-electrically insulated state; a second core coupled to the first core, and for covering the open side of the coil inserting section; and a resin molding section formed to cover the whole area of the plurality of coils.

Here, the plurality of coils may be inter-electrically insulated by an insulating paper, or may be sequentially inserted into the auxiliary spacing portion in the inter-electrically insulated state and is then inserted into the coil inserting section together with the auxiliary spacing portion, or may be inserted into the coil inserting section together with the auxiliary spacing portion after being directly wound around the auxiliary spacing portion.

The auxiliary spacing portion is in mesh shape for enough contact of the resin with the plurality of coils, and the auxiliary spacing portion includes a plurality of projections formed on the outer surface thereof for a uniform thickness of the resin layer.

The resin molding section is preferably formed of a bulk molding compound resin, and the first and second cores may be automatic lamination cores in which a plurality of iron plates are made by simultaneous stamping and caulking processes. In such a case, it is preferable that both edges of the first core opposite from the second core are beveled.

Further, the above objects are accomplished by including a first core having a coil inserting section having one open side; a second coil, a heater coil, a magnetic path core, and a first coil sequentially inserted into the coil inserting section in the inter-electrically insulated state; a second core coupled to the first core for covering the open side of the coil inserting section; and a bulk molding compound resin molding section formed to cover the whole area of the second coil, the heater coil, and the first coil.

Further, the above objects are accomplished by including a first core having a coil inserting section having one open side; a second coil, a heater coil, a magnetic path core, and a first coil sequentially inserted into the auxiliary spacing portion after being inter-electrically insulated by the insulating paper, and then inserted into the coil inserting section together with the auxiliary spacing portion; a second core coupled to the first core for covering the open side of the coil inserting section; and a bulk molding compound resin molding section formed to cover the whole area of the second coil, the heater coil, and the first coil.

Further, the above objects are accomplished by including a first core having a coil inserting section having one open side; a second coil, a heater coil, a magnetic path core, and a first coil sequentially inserted into the auxiliary spacing portion in the inter-electrically insulated state, and then inserted into the coil inserting section together with the auxiliary spacing portion; a second core coupled to the first core for covering the open side of the coil inserting section; and a bulk molding compound resin molding section formed to cover the whole area of the second coil, the heater coil, and the first coil, where the second and first coils are formed of bulk molding compound resin, and the magnetic path core is wrapped by the insulting paper, so that the second coil, the heater coil, the magnetic path core, and the first coil are inter-electrically insulated with each other.

Further, the above objects are accomplished by including a first core having a coil inserting section having one open side; a second coil, a heater coil, a magnetic path core, and a first coil sequentially inserted into the auxiliary spacing portion after being inter-electrically insulated by the insulating paper, and then inserted into the coil inserting section together with the auxiliary spacing portion; a second core coupled to the first core for covering the open side of the coil inserting section; and a bulk molding compound resin molding section formed to cover the whole area of the second coil, the heater coil, and the first coil, where the second coil, the heater coil, and the first coil are directly wound around the auxiliary spacing portion.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
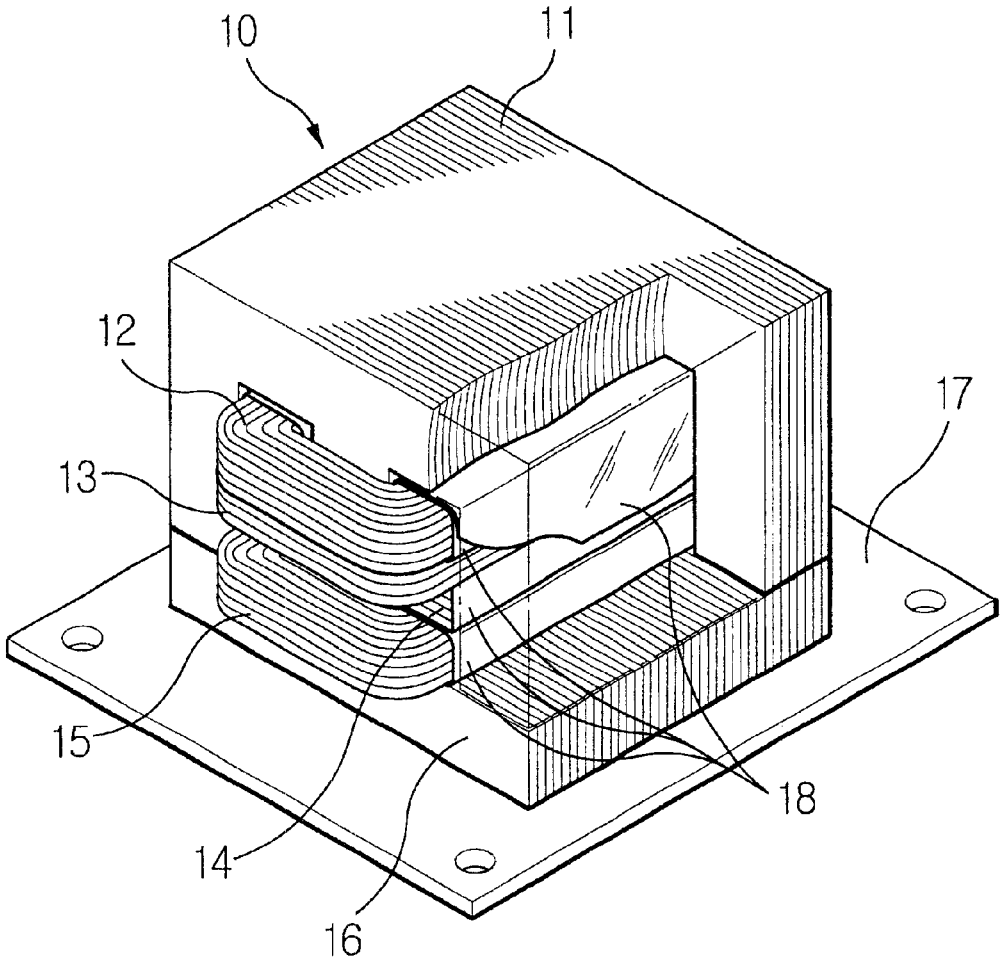
FIG. 1 is a partially cutaway perspective view of a transformer for a microwave oven.

Turning now to the drawings, in FIG. 1, the transformer 10 for a microwave oven includes a first core 11, a second coil 12, a heater coil 13, a magnetic path core 14, a first coil 15, and a second core 16.

The first core 11 includes a plurality of E-shape iron plates. On the middle center portion of the first core 11, the second coil 12 and the heater coil 13, and the first coil 15 are arranged while being interposed by the magnetic path core 14 therebetween. The second core 16 includes a plurality of I-shape iron plates welded with each other, and is welded to the lower portion of the first core 11. To the lower side of the second core 16, a bracket 17 is welded for mounting the transformer 10 to a device chamber of the microwave oven.

In the transformer 10 for the microwave oven, as a commonly used voltage is applied to the first coil 15, a certain voltage is applied to the heater coil 13 and the second coil 12 in accordance with the turn ratio between the first coil 15 and the heater coil 13 with the second coil 12. To the second coil 12 in particular, a high voltage above 2000V is applied, and accordingly, the respective coils 15, 13, and 12 and the respective cores 11, 14, and 16 are insulated by an insulating paper 18. In the transformer 10 for the microwave oven, however, the insulating paper 18 is easily damaged by humidity or a shock, thus deteriorating the quality of the transformer 10.

Figure 2:
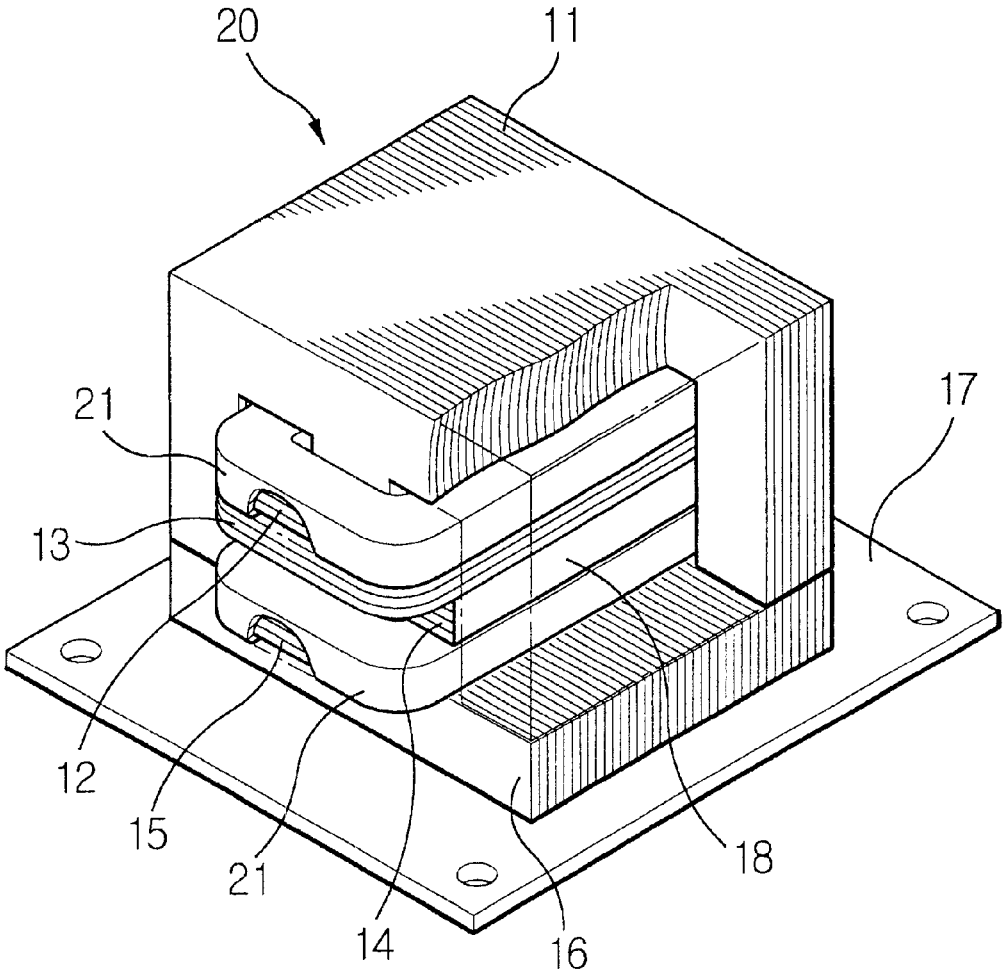
FIG. 2 is a partially cutaway perspective view of a transformer for another microwave oven.

FIG. 2 shows the transformer 20 for a microwave oven having a second coil 12 and a first coil 15 molded by a bulk molding compound resin 21 that has high insulating and heat release characteristics to overcome the above-mentioned problem. Such a transformer 20, however, also has a problem of uneasy insertion of the coils 12 and 15 into the first core 11 by a burr of the resin 21 during the molding of the coils 12 and 15.

Further, while molding the resin in the coils 12 and 15, it is hard to form the resin with a uniform thickness, which means it is also hard to maintain uniform insulating or heat resisting characteristics over the whole area of the coils 12 and 15. Further, according to the transformers 10 and 20 for the microwave ovens, a vibration occurs between the coils 12, 13, and 15 during the operation of the transformers 10 and 20 due to the presence of gaps between the cores 11, 14, and 16 and the coils 12, 13, and 15. Accordingly, once the size of the cores 11, 14, and 16 and the coils 12, 13, and 15 is determined, it is hard to adjust the ratio of the voltage applied to the second coil 12 and the heater coil 13 by varying the number of stacks of the magnetic path core 14.

Further, in the transformers 10 and 20 for the microwave oven, when the transformers 10 and 20 are completely assembled, varnish impregnation is performed on the whole area of the transformers 10 and 20. This is for preventing the vibration between the cores 11, 14, and 16 and the coils 12, 13, and 15 caused due to the magnetic field changes, and for improving the heat release characteristics of the coils 12, 13, and 15, and for protecting the coils 12, 13, and 15 from the external factors such as dirt, humidity, foreign substances, etc. It usually takes approximately 3 hours for the varnish impregnation and drying processes, increasing the time for producing the transformers 10 and 20, and the manufacturing cost.

Further, with respect to the portions that should avoid the varnish impregnation such as the terminal formation area or the ground contact part of the bracket 17, a heat resistant tape has to be firstly attached thereto, and there has to be an additional post-impregnation process for removing the varnish therefrom. Further, when using a vacuum impregnating method for the varnish impregnation, the degree of varnish impregnation considerably varies even with a small error of the vacuum level, which occasionally causes a mass of defective products.

Furthermore, in the transformers 10 and 20 for the conventional microwave oven, since the vibration occurs at the respective iron plates forming the respective cores 11, 14, and 16 according to the magnetic field changes, the respective iron plates have to be firmly secured with each other. Accordingly, the iron plates forming the respective cores 11, 14, and 16 are weld-coupled with each other, not by the automatic lamination, adding one more process of welding, and accordingly increasing the manufacturing cost for the transformers 10 and 20.

Figure 3:
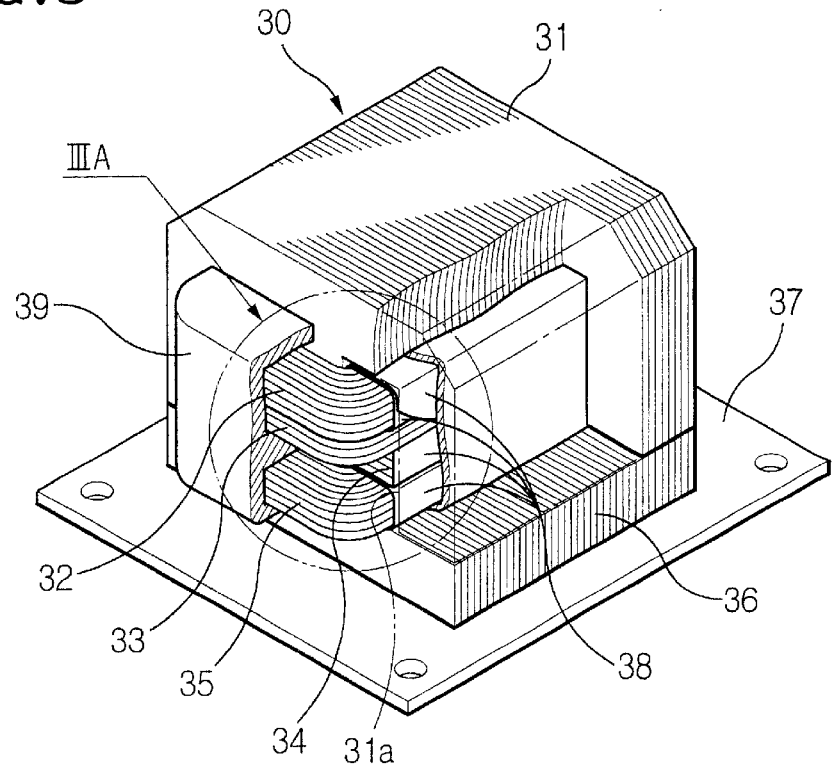
FIG. 3 is a partially cutaway perspective view of a transformer for a microwave oven according to a first preferred embodiment of the present invention.
Figure 3A:
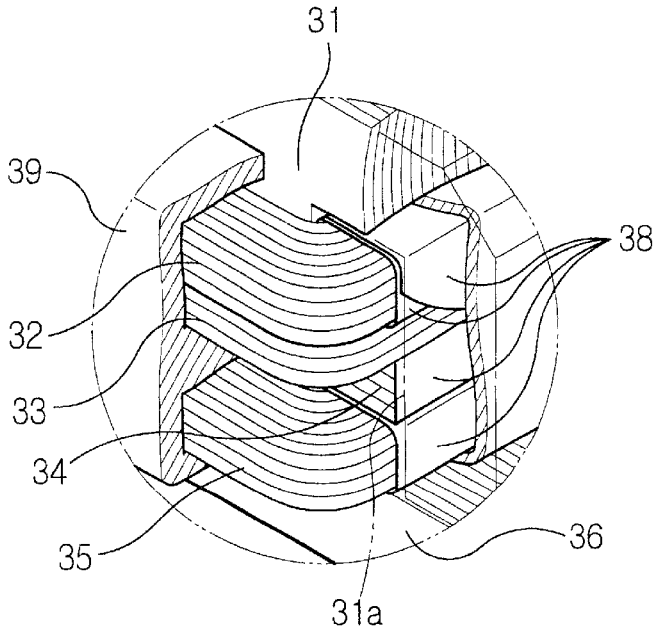
FIG. 3A is an enlarged view of area "IIIA" of FIG. 3.

Referring to FIGS. 3 and 3A, the transformer 30 for the microwave oven according to the present invention includes a first core 31, a second coil 32, a heater coil 33, a magnetic path core 34, a first coil 35, a second core 36, and a resin molding section 39.

The first core 31 includes a plurality of E-shape iron plates coupled with each other, and a coil inserting section 31*a* for receiving the coils 32, 33, and 35 and the magnetic path core 34. Into the coil inserting section 31*a*, the second coil 32, the heater coil 33, the magnetic path core 34, and the first coil 35 are sequentially inserted while being insulated from each other by an insulating paper 38.

The second core 36 includes a plurality of I-shaped iron plates, and is welded to the lower side of the first core 31. To the lower side of the second core 36, a bracket 37 is welded for mounting the transformer 30 to a device chamber of the microwave oven. In such a situation, the transformer 30 is inserted into a metal mold that is mounted on an injection molding machine (not shown), and a resin molding section 39 is formed of bulk molding compound resin having high insulating and heat releasing characteristics, covering the whole area of the coils 32, 33, and 35.

Here, due to high pressure of the injection molding machine, the resin is penetrated between the respective cores 31, 34, and 36 and the respective coils 32, 33, and 35, and accordingly, the respective cores 31, 34, and 36 and the respective coils 32, 33, and 35 are completely insulated. Thus, according to the transformer for the microwave oven according to the first preferred embodiment of the present invention, the possible damage of insulating paper 38 is prevented by the resin molding section 39, and quality deterioration due to the damaged insulating paper 38 is prevented.

Further, since the resin molding process is performed while the second and first coils 32 and 35 are inserted into the first core 31, the difficulty of inserting the coils 32 and 35 due to the burr of the conventional respective coils is prevented. Further, the gaps between the respective cores 31, 34, and 36 with the respective coils 32, 33, and 35 are filled with the resin, so vibration does not occur at the coils 32, 33, and 35 during the operation of the transformer 30. Accordingly, even after the size of the cores 31, 34, and 36, and the coils 32, 33, and 35 is determined, the number of stacks of the magnetic path core 34 may be varied to a certain limit, so that the ratio of voltage applied to the second coil 32 and the heater coil 33 can be adjusted.

Furthermore, due to the resin molding section 39, the vibration at the coils 32, 33, and 35 is prevented, and the heat releasing characteristic is improved, and also, the coils 32, 33, and 35 are protected from the external harmful factors. Further, as the resin penetrates into the gaps between the respective cores 31, 34, and 36 with the respective coils 32, 33, and 35 is hardened, the plurality of iron plates forming the respective cores 31, 34, and 36 are firmly secured to each other, so that the vibration at the iron plates is prevented.

Accordingly, there is no need for the separate varnish impregnation process, and the iron plates forming the respective cores 31, 34, and 36 are not required. Accordingly, the manufacturing cost of the transformer 30 is reduced. Meanwhile, it is preferable that the respective cores 31, 34, and 36 are automatic lamination cores in which a plurality of iron plates are made by simultaneous stamping and caulking processes, and both upper edges of the first core 31 are beveled for limiting possible vibration.

Figure 4:
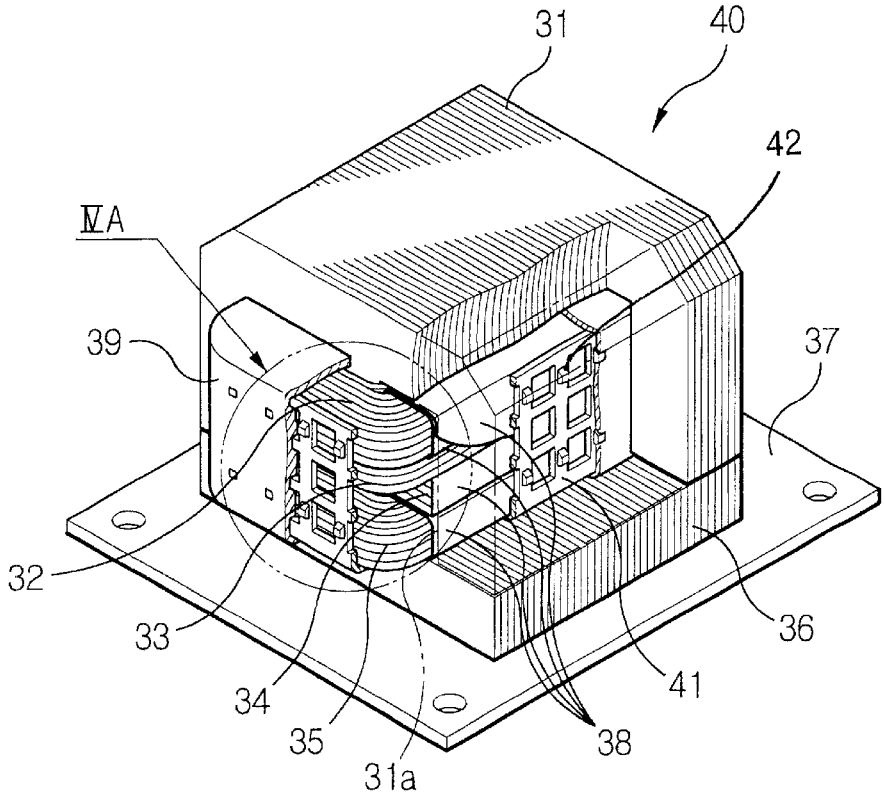
FIG. 4 is a partially cutaway perspective view of a transformer for a microwave oven according to a second preferred embodiment of the present invention.
Figure 4A:
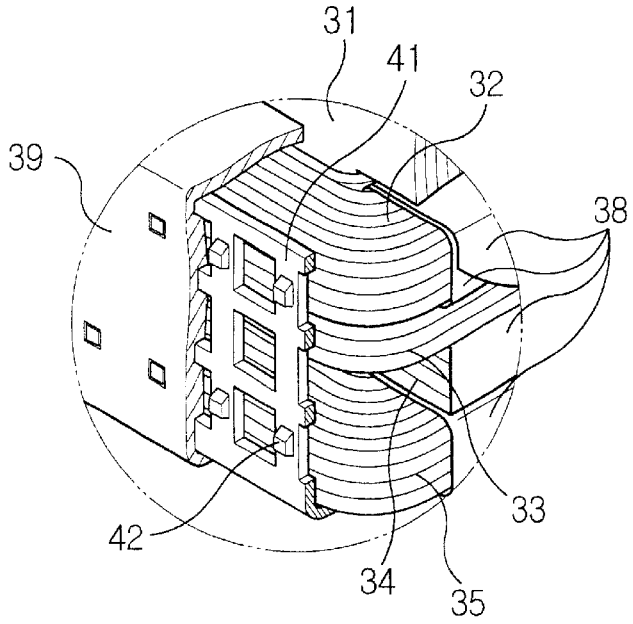
FIG. 4A is an enlarged view of area "IVA" of FIG. 4.

Referring to FIGS. 4 and 4A, the transformer 40 for the microwave oven according to the second preferred embodiment of the present invention has almost the same structure with that of the first preferred embodiment, except for the fact that an auxiliary spacing portion 41 is further disposed between the first core 31 and the respective coils 32, 33, and 35.

More specifically, the second coil 32, the heater coil 33, the magnetic path core 34, and the first coil 35 are inserted into the auxiliary spacing portion 41 while being inter-electrically insulated by an insulating paper 38. In such a situation, the auxiliary spacing portion 41 is inserted into the coil inserting section 31 a of the first core 31, and accordingly, the second coil 32, the heater coil 33, the magnetic path core 34, and the first coil 35 are inserted into the first core 31.

In order to receive the coils 32, 33, and 35, and the core 34, the upper portion of the auxiliary spacing portion 41 is open, and is in mesh shape for sufficient contact of the bulk molding compound resin with the respective coils 32, 33, and 35 during the resin molding of the transformer 40. Further, the auxiliary spacing portion 41 includes a plurality of projections 42 formed on the external surface of the auxiliary spacing portion 41, for ensuring that the thickness of the bulk molding compound resin is enough for insulating and heat releasing purposes, and for preventing an inclination of the respective coils 32, 33, and 35 within the metal mold. Meanwhile, the second core 36 is welded to the lower portion of the first core 31, and in this state, the transformer 40 is inserted into the metal mold (not shown). Accordingly, a resin molding section 39 is formed, covering the whole area of the respective coils 32, 33, and 35.

Thus, according to the transformer 40 of the second preferred embodiment of the present invention, the inclination of the coils 32, 33, and 35 within the metal mold is prevented because of the projections 42, and there is an additional advantage of maintaining the uniform thickness of the coating resin.

Figure 5:
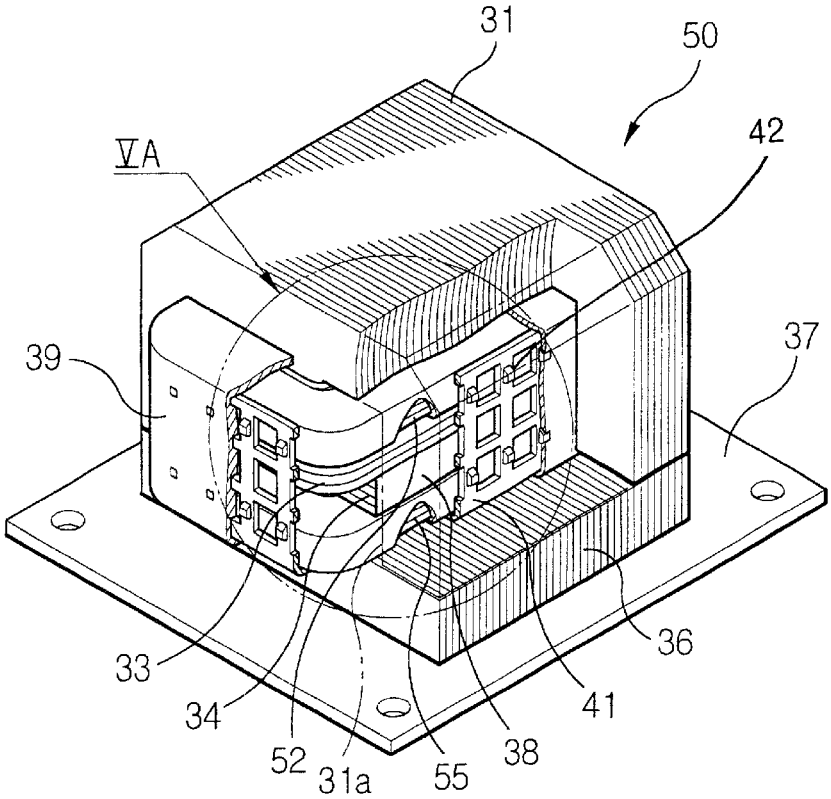
FIG. 5 is a partially cutaway perspective view of a transformer for a microwave oven according to a third preferred embodiment of the present invention.
Figure 5A:
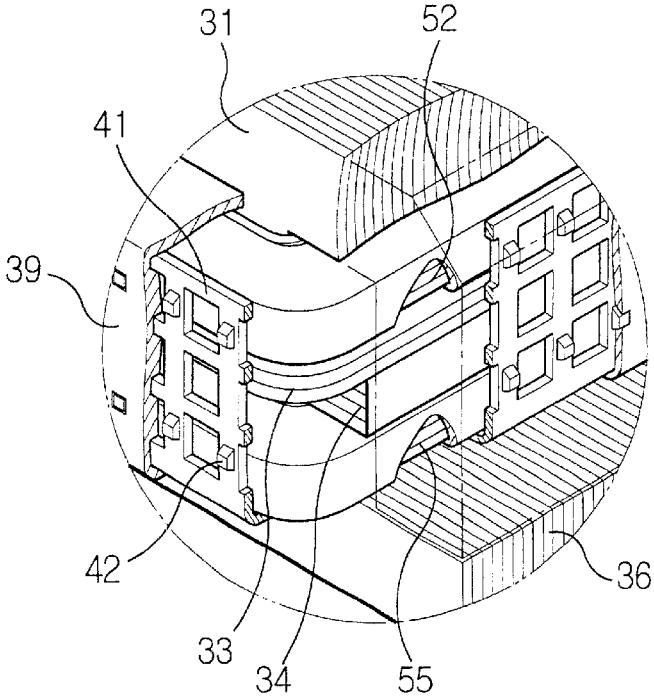
FIG. 5A is an enlarged view of area "VA" of FIG. 5.

Referring to FIGS. 5 and 5A, the transformer according to the third preferred embodiment has almost the same structure as that of the second preferred embodiment, except for the fact that the second and first coils 52 and 55 made of the bulk molding compound resin are welded before the second and first coils 52 and 55 are inserted into the auxiliary spacing portion 41.

More specifically, the second and first coils 52 and 55 are first molded by the bulk molding compound resin, and the magnetic path core 34 is inserted into the auxiliary spacing portion 41 while being insulated by the insulating paper 38. In such a situation, the auxiliary spacing portion 41 is inserted into the coil inserting section 31*a* of the first core 31, and accordingly, the second coil 52, the heater coil 33, the magnetic path core 34, and the first coil 55 are sequentially inserted into the first core 31.

The second core 36 is welded to the lower portion of the first core 31, and in this state, the transformer 50 is inserted into a metal mold (not shown). Accordingly, the resin molding section 39 is formed, covering the whole area of the respective coils 52, 33, and 55.

Figure 6:
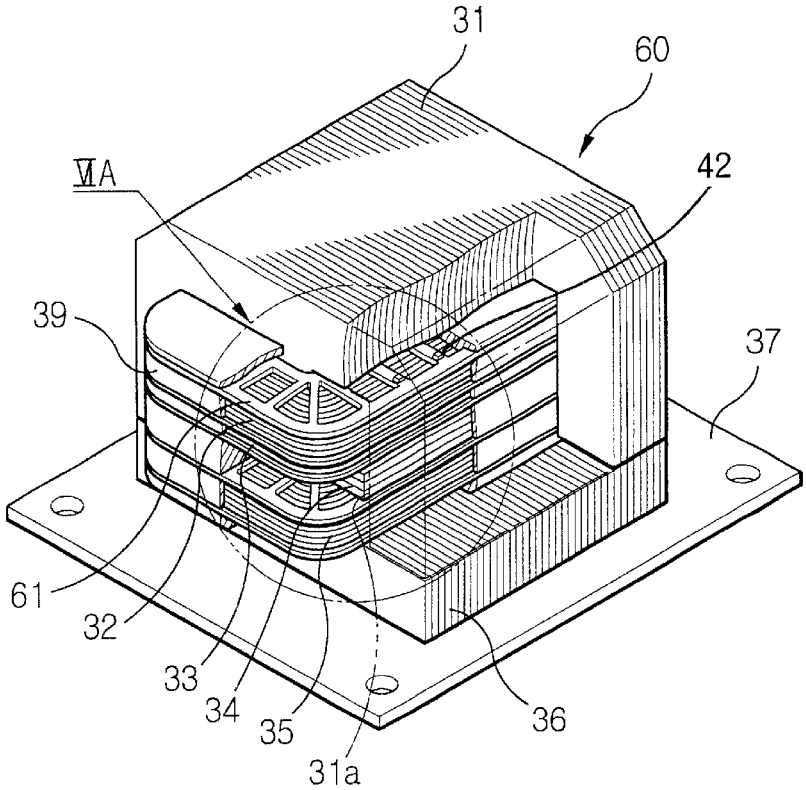
FIG. 6 is a partially cutaway perspective view of a transformer for a microwave oven according to a fourth preferred embodiment of the present invention.
Figure 6A:
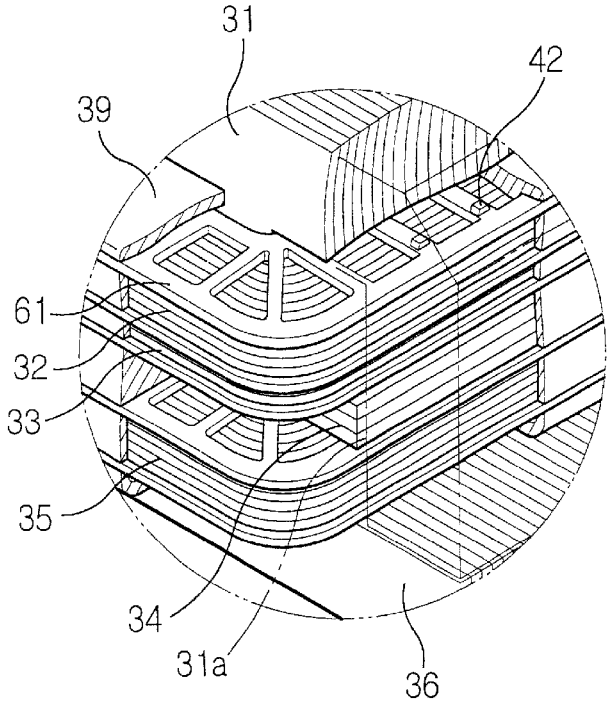
FIG. 6A is an enlarged view of area "VIA" of FIG. 6A.

As shown in FIGS. 6 and 6A, the transformer 60 for the microwave oven according to the fourth preferred embodiment has almost the same structure as that of the second preferred embodiment except for the fact that the second coil 32, the heater coil 33, and the first coil 35 are directly wound around the auxiliary spacing portion 61.

More specifically, the second coil 32, the heater coil 33, and the first coil 35 are directly wound around the auxiliary spacing portion 61, and the magnetic path core 34 is inserted into both sides of the auxiliary spacing portion 61, while not being insulated separately. For winding the coils 32, 33, and 35, the auxiliary spacing portion 61 has open outer sides, and is in mesh shape for sufficient contact of the bulk molding compound resin with the respective coils 32, 33, and 35 during the resin molding the transformer 60.

To the lower end of the first core 31, the second core 36 is welded, and in this state, the transformer 60 is inserted into the metal mold (not shown). Accordingly, the resin molding section 39 is formed, covering the whole area of the respective coils 32, 33, and 35.

As described above, according to the transformer for the microwave oven constructed according to the present invention, quality deterioration due to the damaged insulating paper prevented, and the uneasy insertion of the coils due to the burr of the resin formed during the coil molding process is also prevented.

Further, while resin molding the coils, the thickness of the coils can be maintained at an uniform degree. Also, even after the size of the cores or the coils is determined, the number of stacks of the magnetic path core is adjustable. Further, the separate varnish impregnation process and the welding processes for the respective cores are not required. Accordingly, the manufacturing cost is significantly reduced.

While the present invention has been particularly shown and described with reference to the preferred embodiments thereof, it will be understood by those skilled in the art that various changes in form and details may be effected therein without departing from the spirit and scope of the invention as defined by the appended claims.

What is claimed is:

1. A transformer for a microwave oven, comprising:

a first core having a coil inserting section having one open side;

a plurality of coils sequentially inserted by a predetermined order into the coil inserting section, said coils being electrically insulated from each other;

a second core coupled to the first core, and for covering the open side of the coil inserting section; and a resin molding section formed while the plurality of coils are inserted into the first core to cover the whole area of the plurality of coils, said resin molding section being penetrated and hardened in the gaps between the respective first and second cores and the respective plurality of coils and accordingly, the respective first and second cores and the respective plurality of coils being completely insulated, the hardening of the resin of said resin molding section penetrated into the gaps between the first core, second core, and the plurality of coils firmly securing the first and second cores to each other.

2. The transformer of claim 1, with said coils being electrically insulated by an insulating paper.

3. The transformer of claim 1, with said resin molding section being formed of a bulk molding compound resin.

4. The transformer of claim 1, with said first and second cores being automatic lamination cores having a plurality of iron plates made by simultaneous stamping and caulking processes.

5. The transformer of claim 1, with the plurality of coils being sequentially inserted into an auxiliary spacing portion, said coils being electrically insulated from each other, and are then inserted into said coil inserting section together with said auxiliary spacing portion.

6. The transformer of claim 5, with said auxiliary spacing portion being in a mesh shape accommodating contact of said resin molding section with said plurality of coils.

7. The transformer of claim 6, with said auxiliary spacing portion comprising a projection formed on an outer surface of said auxiliary spacing portion accommodating a uniform thickness of said resin molding section.

8. The transformer of claim 5, with the plurality of coils being directly wound around said auxiliary spacing portion.

9. A transformer for a microwave oven, comprising:

a first core having a coil inserting section having one open side;

a plurality of coils sequentially inserted by a predetermined order into the coil inserting section, said coils being electrically insulated from each other;

a second core coupled to the first core, and for covering the open side of the coil inserting section; and a resin molding section formed to cover the whole area of the plurality of coils, with said first and second cores being automatic lamination cores having a plurality of iron plates made by simultaneous stamping and caulking processes, with both edges of said first core opposite from said second core being beveled.

10. A transformer of a microwave oven, comprising:

a first core having a coil inserting section having one open side;

a second coil, a heater coil, a magnetic path core, and a first coil being electrically insulated by an insulating paper and sequentially inserted into the coil inserting section;

a second core coupled to said first core covering the open side of said coil inserting section; and a bulk molding compound resin section formed while the first and second coils are inserted into the first core to cover the whole area of said second coil, said heater coil, and said first coil, the bulk molding compound resin from said bulk molding compound resin section penetrating and hardening in the gaps between the first core, second core, magnetic path core, first coil, second coil, and heater coil.

11. A transformer for a microwave oven, comprising:

a first core having a coil inserting section having one open side;

a second coil, a heater coil, a magnetic path core, and a first coil sequentially inserted into an auxiliary spacing portion after being electrically insulated from each other by insulating paper, and then inserted into said coil inserting section together with said auxiliary spacing portion;

a second core coupled to said first core covering the open side of said coil inserting section; and a bulk molding compound resin section formed to cover the whole area of said second coil, said heater coil, and said first coil, said bulk molding compound resin section penetrated and hardened in the gaps between the respective first and second cores and the respective plurality of coils and accordingly, the respective first and second cores and the respective plurality of coils being completely insulated, the hardening of the bulk molding compound resin penetrated into the gaps between the first core, second core, and the plurality of coils firmly securing the first and second core with each other.

12. A transformer for a microwave oven comprising:

a first core having a coil inserting section having one open side;

a second coil, a heater coil, a magnetic path core, and a first coil sequentially inserted into an auxiliary spacing portion in an inter-electrically insulated state, and then inserted into the coil inserting section together with said auxiliary spacing portion;

a second core coupled to said first core covering the open side of the coil inserting section; and a bulk molding compound resin section formed to cover the whole area of said second coil, said heater coil, and said first coil, said second and first coils are formed of bulk molding compound resin, and the magnetic path core is wrapped by insulating paper accommodating said second coil, said heater coil, said magnetic path core, and said first coil to be electrically insulated from each other, said bulk molding compound resin section being penetrated between the respective first and second cores and the respective first and second coils and accordingly, the respective first and second cores and the respective first and second coils being completely insulated, the hardening of the bulk molding compound resin section penetrated into the gaps between the first core, second core, and the first and second coils firmly securing the first and second core with each other.

13. A transformer for a microwave oven comprising:

a first core having a coil inserting section having one open side;

an auxiliary spacing portion having a second coil, a heater coil, a magnetic path core, and a first coil respectively inserted into said auxiliary spacing portion after being insulated from each other by insulating paper, and then inserted into the coil inserting section together with said auxiliary spacing portion;

a second core coupled to said first core covering the open side of the coil inserting section; and a bulk molding compound resin section formed while the first and second coils are inserted into the first core to cover the whole area of the second coil, the heater coil, and the first coil, the second coil, the heater coil, and the first coil are directly wound around said auxiliary spacing portion, said bulk molding compound resin section being penetrated and hardened in the gaps between the respective first and second cores and the respective first and second coils and accordingly, the respective first and second cores and the respective first and second coils being completely insulated, the hardening of the bulk molding compound resin section penetrated into the gaps between the first core, second core, and the first and second coils firmly securing the first and second core with each other.

14. A method of making a transformer for a microwave oven, comprising the steps of:

forming a first core having a coil inserting section, said coil inserting section having one open side;

electrically insulating a first coil, a heater coil, a magnetic path core, and a second coil from each other;

inserting said second coil, said heater coil, said magnetic path core, and said first coil into said coil inserting section;

coupling a second core to said first core covering the open side of said coil inserting section; and forming a resin molding section covering the whole area of said second coil, said heater coil, and said first coil while said first and second coils are inserted into said first core, said resin molding section being penetrated and hardened in the gaps between the respective first, second and magnetic path cores and the respective first, second, and heater coils and accordingly, the respective first, second and magnetic path cores and the respective first, second and heater coils being completely insulated, the hardening of the resin of said resin molding section penetrated into the gaps between the first core, second core, magnetic path core and the first, second and heater coils firmly securing the first, second and magnetic path core to each other.

15. The method of claim 14, with said electrically insulating a first coil, a heater coil, a magnetic core, and a second coil from each other by an insulating paper.

16. The method of claim 15, with said resin molding section being formed of a bulk molding compound resin.

17. The method of claim 14, further comprising the step of changing the number of stacks of said magnetic path core after a size of said first core, second core, magnetic path core, first coil, second coil, and heating coil is determined, said changing of a number of stacks of said magnetic path core adjusting a ratio of voltage applied to said second coil and said heater coil.

18. A method of making a transformer for a microwave oven, comprising the steps of:

forming a first core having a coil inserting section, said coil inserting section having one open side;

electrically insulating a first coil, a heater coil, a magnetic path core, and a second coil from each other by an insulating paper;

inserting said second coil, said heater coil, said magnetic path core, and said first coil into said coil inserting section;

coupling a second core to said first core covering the open side of said coil inserting section; and forming a resin molding section covering the whole area of said second coil, said heater coil, and said first coil, with said resin molding section being formed of a bulk molding compound resin, with said first and second cores being automatic lamination cores having a plurality of iron plates made by simultaneous stamping and caulking processes.

19. The method of claim 18, with both edges of said first core opposite from said second core being beveled.

20. The method of claim 19, with said step of inserting said second coil, said heater coil, said magnetic path core, and said first coil into said coil inserting section being respectively inserted.

21. The method of claim 20, after said insulation step further comprising the step of inserting respectively said second coil, said heater coil, said magnetic path core, and said first coil into an auxiliary spacing portion.

22. The method of claim 21, with said auxiliary spacing portion being in a mesh shape accommodating contact of said resin molding section with said first coil, said second coil, and said heater coil.

23. The method of claim 22, with said auxiliary spacing portion comprising a plurality of symmetrically spaced projections formed on an outer surface of said auxiliary spacing portion accommodating a uniform thickness of said resin molding section.

24. The method of claim 23, with said first coil, said heater coil, and said second coil being directly wound around said auxiliary spacing portion.

25. The method of claim 24, with said magnetic path core being inserted into both sides of said auxiliary spacing portion, said magnetic path core not being separately insulated.

26. The method of claim 23, further comprising the step of welding said second coil with said first coil before said second coil and said first coil are inserted into said auxiliary spacing portion.

27. A method of making a transformer for a microwave oven, comprising the steps of:

forming a first core having a coil inserting section, said coil inserting section having one open side;

electrically insulating a first coil, a heater coil, a magnetic path core, and a second coil from each other;

inserting said second coil, said heater coil, said magnetic path core, and said first coil into said coil inserting section;

coupling a second core to said first core covering the open side of said coil inserting section; and forming a resin molding section covering the whole area of said second coil, said heater coil, and said first coil, with said forming resin molding step further comprising the steps of:

penetrating a resin into gaps between said first core, second core, magnetic path core, first coil, second coil, and said heater coil; and hardening said resin within the gaps between said first core, second core, magnetic path core, first coil, second coil, and said heater coil.

* * * * *